United States Patent [19]

Nishikawa et al.

[11] Patent Number: 4,890,452

[45] Date of Patent: Jan. 2, 1990

[54] APPARATUS FOR CONTROLLING OPERATION OF SPINNING FRAME IN ROVING BOBBIN EXCHANGE SYSTEM

[75] Inventors: Hirotaka Nishikawa, Ichinomiya; Sadao Ukai, Nagoya; Kanehiro Ito, Aichi, all of Japan

[73] Assignee: Howa Machinery, Ltd., Japan

[21] Appl. No.: 280,580

[22] Filed: Dec. 6, 1988

[30] Foreign Application Priority Data

Dec. 10, 1987 [JP] Japan ..... 62-312941

[51] Int. Cl.[4] ..... D01H 9/14; D01H 13/24

[52] U.S. Cl. ..... 57/276; 57/81; 57/264

[58] Field of Search ..... 57/264, 265, 268, 270, 57/276, 281, 80, 81

[56] References Cited

U.S. PATENT DOCUMENTS

| | | | |
|---|---|---|---|
| 3,905,184 | 9/1975 | Takai et al. | 57/274 |
| 4,145,868 | 3/1979 | Morita et al. | 57/268 |
| 4,799,353 | 1/1989 | Kawasaki et al. | 57/281 |

FOREIGN PATENT DOCUMENTS

| | | |
|---|---|---|
| 0213962 | 3/1987 | European Pat. Off. . |
| 62-53425 | 3/1987 | Japan . |
| 62-62929 | 3/1987 | Japan . |
| 64-52828 | 2/1989 | Japan . |

*Primary Examiner*—John Petrakes

*Attorney, Agent, or Firm*—Stevens, Davis, Miller & Mosher

[57] ABSTRACT

An apparatus for controlling a drive of each one of spinning frames forming a group, to which a conventional roving bobbin exchange operation for exchanging almost exhausted roving bobbins of the spinning frame with full packaged roving bobbins of a bobbin carrier on a supply rail arranged at a position close to and above the corresponding spinning frame by a known automatic apparatus mounted on a carrier which is capable of displacing along a track arranged on a floor of a spinning factory along an alignment of out-end frames of said spinning frames, is applied, wherein during the spinning operation, a residual roving quantity of the roving bobbins of each spinning frame is measured, while detecting a quantity of yarn wound on cops in each spinning frame, and when the above-mentioned measurement of a residual quantity of roving bobbins reaches a predetermined value, a first signal indicating this condition is issued, while the quantity of yarn wound on the cops is measured to detect a suitable condition to start the above-mentioned roving bobbin exchange operation, and when this suitable condition is detected, a second signal indicating this condition is outputted, then a signal calling the automatic apparatus is outputted based upon the logical product of these two signals, and an allowable time for the arrival of the automatic apparatus at a working position close to a particular position and close to the out-end frame of a spinning frame is set, and if the automatic apparatus for exchanging roving bobbins does not arrive at the above-mentioned working position within the allowable time, the drive of the spinning frame concerned is stopped by a means for controlling the drive of the spinning frames which cooperates with the measurement of a residual quantity of a roving bobbin and measurement of a quantity of yarn wound on the cops.

6 Claims, 5 Drawing Sheets

APPARATUS FOR CONTROLLING OPERATION OF SPINNING FRAME IN ROVING BOBBIN EXCHANGE SYSTEM

BACKGROUND OF THE INVENTION

1. Field of the Invention

The present invention relates to an apparatus for controlling the operation of a spinning frame in relation to a roving bobbin exchange system, wherein almost exhausted roving bobbins of bobbin hangers of a creel of a spinning frame are intermittently exchanged for corresponding full packaged roving bobbins suspended by bobbin hangers of a bobbin carriage carried to a working position thereof on a supply rail arranged along the longitudinal direction of the spinning frame, by means of a roving bobbin exchange apparatus which is capable of moving along a spindle rail of the spinning frame, in parallel to the operation for piecing rovings between a starting-end of a roving of each full packaged roving bobbin being subjected to the roving bobbin exchange operation with a rear end of roving from a corresponding almost exhausted roving bobbin which is still supplying the roving to the spinning frame.

2. Description of the Related Art

The following apparatuses can be utilized as the above-mentioned roving bobbin exchange apparatus. Namely, the apparatus as disclosed in European Laid-open Patent Publication No. 0213962, which corresponds to Japanese Unexamined Patent Publication Sho No. 62-53425, whereby the roving bobbin exchange operation is applied to a spinning frame. In this spinning system, at the starting condition, half exhausted roving bobbins are suspended by respective back-row bobbin hangers in a creel of each spinning frame while full packaged roving bobbins are suspended by respective front-row of bobbin hangers in the creel, and therefore, when the above-mentioned half-exhausted roving bobbins become almost exhausted, as a first step, the almost exhausted roving bobbins are exchanged for roving bobbins having packaging condition of which has changed from full size to half size. In other words, all roving bobbins on the front row of the creel are exchanged for facing roving bobbins on the back row of the creel, to suspended all of the almost exhausted roving bobbins by the respective front row of bobbin hangers of the creel, and thereafter, the above-mentioned roving bobbin exchange operation is carried out and the almost exhausted roving bobbins of the front row of bobbin hangers in the creel of the spinning frame are intermittently exchanged for corresponding full packaged roving bobbins of the bobbin hangers on the bobbin carriage on the supply rail, from one end of the spinning frame to the other end thereof along the spindle rail during the spinning operation, in parallel to the operation for piecing a starting end of a roving of each full packaged roving bobbin with a rear end of a roving from a corresponding almost exhausted roving bobbin which is still supplying the roving to the spinning frame. In the above-mentioned operation, a unit operation applied to plural adjacent pair of a front and back bobbin hangers of the creel, facing each other, of the spinning frame is intermittently carried out from one end of the spinning frame to the other end thereof. In the other type of roving bobbin exchange apparatus applied to such a spinning frame, as disclosed in Japanese Unexamined Patent Publication Sho 62-205149 (U.S. patent application Ser. No. 089,604, now U.S. Pat. No. 4,799,353 of Jan, 24, 1989), half exhausted roving bobbins and full packaged roving bobbins are alternately suspended by the front row and the back row of the bobbin hangers in the creel of the spinning frame, respectively, in a condition such that each front row bobbin hanger suspending a half exhausted roving bobbin faces a corresponding back row bobbin hanger suspending a half exhausted roving bobbin, while each front row bobbin hanger suspending a full packaged roving bobbin faces a corresponding back row bobbin hanger suspending a full packaged roving bobbin, at the start of the spinning operation. Therefore, when the above-mentioned half exhausted roving bobbins reach an almost exhausted condition, each pair of such almost exhausted roving bobbins suspended by a corresponding front row bobbin hanger and back row bobbin hanger, facing each other, are exchanged for full packaged roving bobbins of the bobbin carriage on the supply rail, in parallel to the operation for piecing a starting-end of a roving of each full packaged roving bobbin being subjected to the roving bobbin exchange operation with a rear-end of a roving from the corresponding almost exhausted roving bobbin which is still supplying a roving to the spinning frame. In the above-mentioned roving bobbin exchange operation, usually a signal is outputted to request a roving bobbin exchange operation from the spinning frames, accordingly, the consumed condition of roving bobbins suspended by the bobbin hangers of the creel of the spinning frame is measured in each spinning frame, and when the size of the roving bobbins in the half exhausted condition reaches the almost exhausted condition in a certain spinning frame, the above-mentioned request signal is outputted from this spinning frame to call the roving bobbin exchange apparatus, as disclosed in Japanese Unexamined Patent Publication Sho No. 62-62929.

If the method disclosed in Japanese Unexamined Patent Publication No. Sho 62-62929 is combined with the roving bobbin exchange system utilizing the above-mentioned roving bobbin exchange operation, since the quantity of roving supplied is measured and the exchange of roving bobbins is carried out based upon the operative condition of each spinning frame with respect to the quantity of the roving bobbins, it is not necessary to stop the spinning frame for the roving bobbin exchange operation, and even if a spinning frame is stopped, an exchange of roving bobbins is not performed until the quantity of the roving of the above-mentioned half exhausted roving bobbins reaches a predetermined condition, i.e., an almost exhausted condition. This produces an advantage in that the quantity of the residual roving can be remarkably reduced so that the roving can be effectively utilized as the spinning material. Nevertheless, since one roving bobbin exchanging apparatus is utilized for a group of spinning frames, it is possible that an overlapping of demand signals requesting the bobbin exchange operation from a plurality of spinning frames will occur. In the conventional spinning frame, even after the output of the above-mentioned demand signal from a spinning frame, the spinning operation is still continued, and accordingly, in a spinning frame which has last outputted such a demand signal, it is possible that the above-mentioned half exhausted roving bobbins will be completely exhausted, and thus the end of a roving on a full packaged roving bobbin, which is being subjected to the roving bobbin exchange operation, cannot be connected to the rear end of the roving on the roving bobbins which should be maintained almost exhausted condition, however, was actually completely exhausted condition, and therefore a problem due to a discontinuation of the spinning operation arises.

SUMMARY OF THE INVENTION

The present invention relates to an apparatus for controlling an operation of a spinning frame in a roving bobbin exchange system, to solve the above-mentioned problem of the conventional roving bobbin exchange system. In a roving bobbin exchange system wherein the roving bobbin exchange operation is carried out in parallel to the above-mentioned piecing operation, according to the present invention, there is provided an apparatus for controlling the operation of a spinning frame, which comprises means for outputting a first signal indicating a residual quantity of a roving on a roving bobbin, based upon a measurement of the quantity of roving supplied from the roving bobbins which correspond to the above-mentioned half exhausted roving bobbins, means for outputting a second signal demanding an application of the roving bobbin exchanging operation, based upon the detection of a pertinent condition for carrying out the bobbin exchange operation by measuring the quantity of yarn produced, these two means being disposed on each spinning frame, and a control circuit for outputting a calling signal for calling the roving bobbin exchange apparatus based upon the logical product of the first and second signals. An approach confirmation switch for confirming the approach of the roving bobbin exchange apparatus to a working position thereof close to a spinning frame which has output the above-mentioned calling signal, and means for setting an allowable time to the roving bobbin exchange apparatus from a time, that the above-mentioned calling signal is outputted, to a time at which the roving bobbin exchange apparatus starts to carry out the roving exchange operation, are involved in the above-mentioned control circuit, so that if the confirmation switch does not output a confirm signal after the above-mentioned calling signal is outputted within the above-mentioned allowable time, the drive motor of the spinning frame which has output the calling signal is stopped. Accordingly, if the roving bobbin exchange apparatus does not arrive at the working position thereof in the proximity of a spinning frame from which the above-mentioned calling signal has been outputted, within the above-mentioned allowable time, the drive of the spinning frame is stopped so that the roving bobbins, which are in an almost exhausted condition, still carry a residual roving thereon which is necessary for carrying out the piecing thereof with a starting end of a roving of the full packaged roving bobbins. Accordingly, the above-mentioned problem of the conventional roving bobbin exchange system can be solved.

DETAILED DESCRIPTION OF THE INVENTION

The apparatus for controlling the operation of a spinning frame in a roving bobbin exchange system according to the present invention will now be described in detail with reference to an embodiment thereof, wherein the roving bobbin exchange operation is carried out for conventional spinning frames provided with a device for simultaneously doffing full packaged cops, by utilizing the roving bobbin exchange apparatus disclosed in Japanese Patent Application No. Sho 62-205149 and U.S. patent application Ser. No. 089,604 (now U.S. Pat. No. 4,799,353 ).

Figure 1:
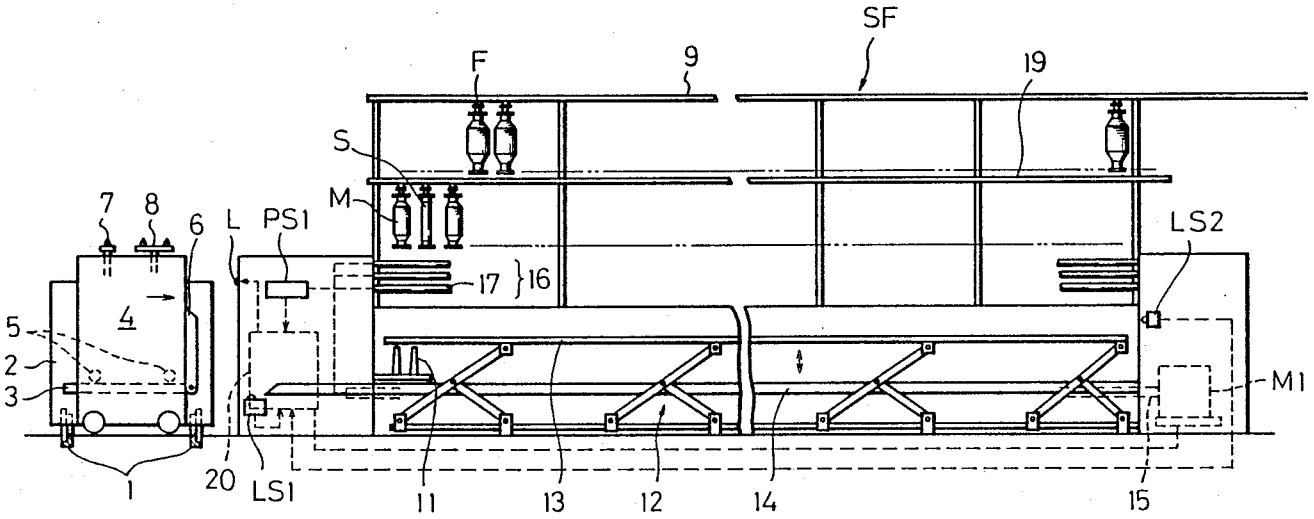
FIG. 1 is a front view of a spinning frame provided with a simultaneous cop doffing apparatus, showing a situation wherein a roving bobbin exchange apparatus is approaching the working position.
Figure 2:
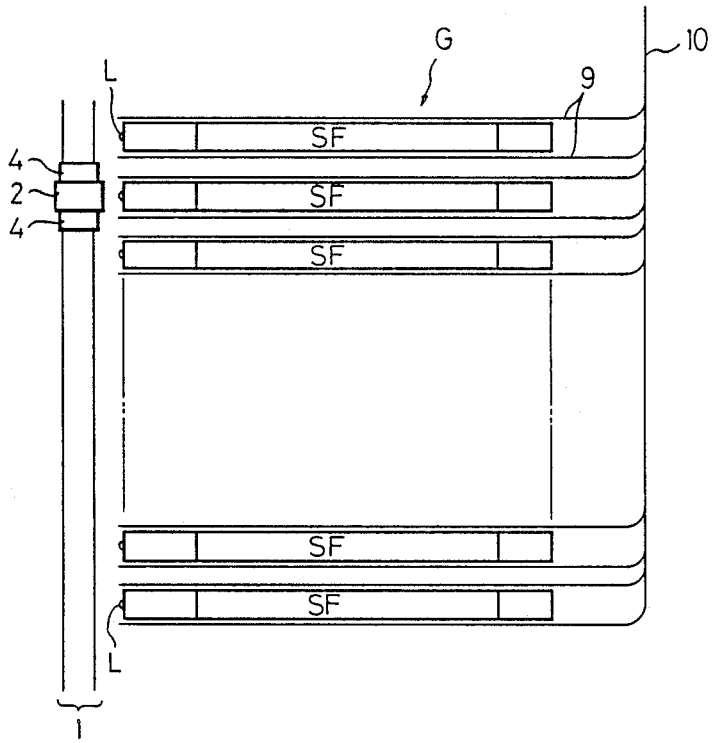
FIG. 2 is a plan view showing the entire structure of the roving bobbin exchange system to which the present invention is applied.
Figure 6:
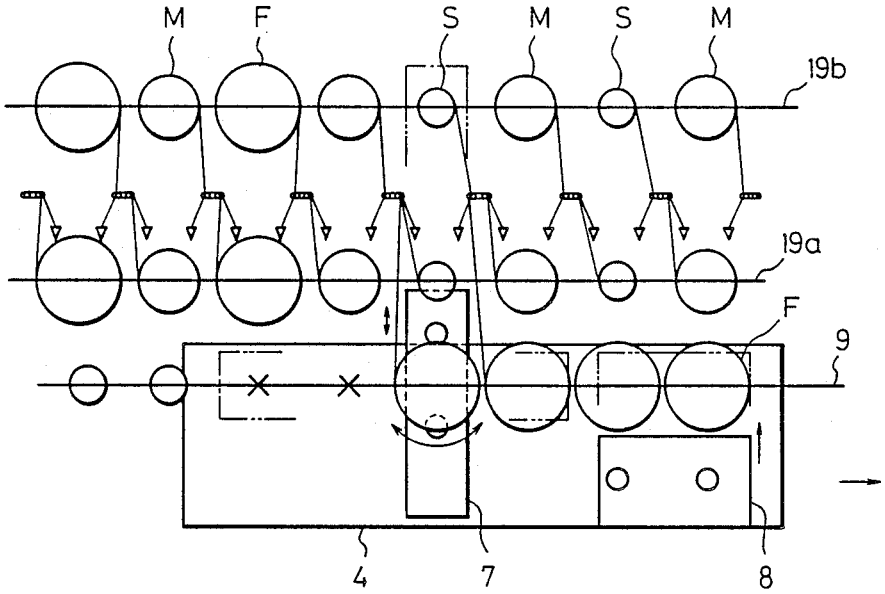

Referring to FIG. 2, a plurality of spinning frames SF are installed on a floor of a spinning factory as a group G. A track 1 composed of a pair of parallel rails is laid out on the floor along the frame-ends of the spinning frames SF of the group G, and a carrier 2 is movably arranged on the track 1 so that the direction of the carrier 2 is reversed at both end terminals of the track 1. The carrier 2 is constructed so that, when it is confirmed that a lamp L is lit during the displacing motion of the carrier 2, the carrier 2 is stopped at a working position facing the frame-end of the spinning frame SF concerned. As shown in FIG. 1, loading rails 3 for loading an apparatus 4 for exchanging roving bobbins thereon are rigidly disposed at both sides of the carrier 2, and rotary wheels 5 of the apparatus 4 are rotatably mounted on the loading rails 3, respectively, to support the apparatus 4. Bridge rails 6 to be connected to guide rails, described hereinafter, of the spinning frame SF are attached to the front of the loading rails 3. As shown in FIGS. 1 and 6, a pair of pegs 7 utilized for exchanging two almost exhausted roving bobbins S suspended by front and back bobbin hangers, facing each other in the creel 19, for two full packaged roving bobbins F suspended by two adjacent bobbin hangers of the supply rail, and another pair of pegs 8 utilized for carrying out a piecing of each of the free ends of rovings of the above-mentioned full packaged roving bobbins F and rear ends of rovings of the corresponding above-mentioned almost exhausted roving bobbins S during a supply of rovings to the spinning frame, are disposed on the roving bobbin exchange apparatus 4. As already described, supply rails 9 are arranged along the corresponding spinning frames SF, at a position close thereto and slightly higher than the top of each spinning frame SF, respectively, and connected at the ends thereof to a main rail 10, as shown in FIG. 2, and this main rail 10 is extended to the working position close to a group of roving frames (not shown) so that bobbin carriages (not shown) are able to transport roving bobbins (empty or full package condition) between the working places of the bobbin carrier 2 close to the spinning frames SF and the working places thereof close to the roving frames.

In this embodiment, each spinning frame SF is provided with an automatic doffing and donning device 12 which is able to simultaneously doff full packaged cops from all spindles 11 of one side of the frame and simultaneously don fresh bobbins on these spindles 11, by utilizing a doffing and donning bar 13, as shown in U.S. Pat. No. 3,905,184. The spinning frame whereat the automatic doffing and donning apparatus is able to be displaced along a spindle rail thereof, as disclosed in U.S. Pat. No. 4,145,868, is also applicable for the present invention.

In this embodiment, each spinning frame SF is provided with a guide rail 14, which extends from an out-end to a gear end of the frame SF, at each side thereof. At either the out-end or gear end side of the guide rail 14, there is provided a limit switch LS1 by which the arrival of the roving exchanging apparatus 4 is confirmed, and at the other side end of the guide rail 14, there is provided a second limit switch LS2 by which the completion of the roving bobbin exchange operation is confirmed, by the engagement thereof with the apparatus 4 that has reached that position. A drive motor M1 for driving each spinning frame SF is disposed at an out-end frame thereof, so that the drive power of this motor M1 is transferred to a group of drafting rollers 16 via several gear trains disposed in a gear-end frame, by a main shaft 15 connected to the motor M1.

A first detecting switch PS1 which detects a predetermined length of yarn produced by the spinning frame SF, by closing a contact (for example, a pulser which issues one pulse upon each detection of a predetermined number of rotations of a front roller 17) is connected to the front roller 17. The lamp L, which is lit to indicate that a call has been made for the automatic roving bobbin exchange apparatus 4, is mounted on the gear-end frame of each spinning frame SF. The call lamp L, the first limit switch LS1, the second limit switch LS2, and the first detection switch PS1 are electrically connected to a control circuit 20.

Figure 3:
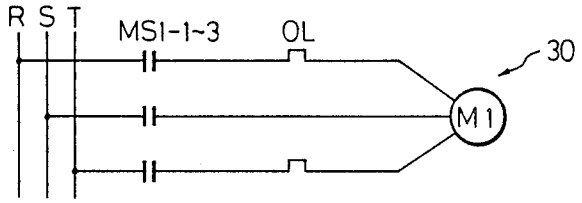
FIG. 3 is a operating diagram of a drive motor of the spinning frame.
Figure 4:
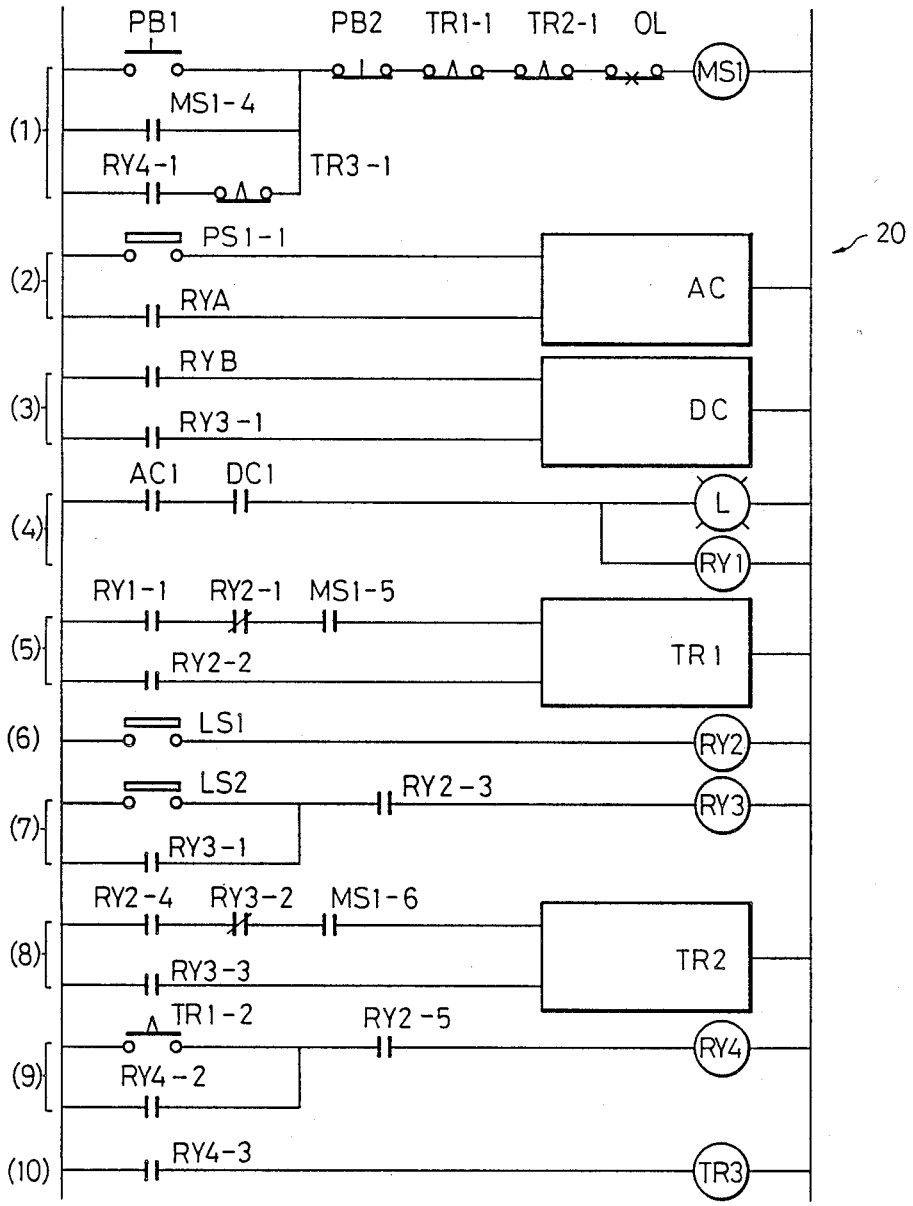
FIG. 4 is a diagram of a control circuit of one embodiment of the present invention.

Next, the construction and function of this control circuit 20 is explained. Referring to FIG. 4, a circuit (1) is a main motor starting and stopping circuit, including a relay MS1 for a main motor circuit 30 (see FIG. 3), and in this circuit (1), time limiting contacts TR1-1 and TR2-1 of timers TR1 and TR2 described hereinafter are connected in series, and a contact RY4-1 of an auxiliary relay RY4 described hereinafter and a timer contact TR3-3 are connected in series in parallel to a push button switch PB1. A circuit (2) is a cop wound quantity indicating circuit for indicating that the wound quantity of cops of the spinning frame SF has reached a suitable condition for an exchange of roving bobbins. In this circuit (2), the contact of the detecting switch PS1 is connected to a counting input of a known automatic counter AC and has a contact RYA, which is closed during an operation of preparing for a doffing (for example, a downwards displacement of a ring rail after the cop becomes full), connected to a reset input of the counter AC, whereby a cop wound quantity indicating means outputs a bobbin exchange signal (first signal), by closing a counter contact AC1 arranged in the control circuit 20 when the detection switch PS1 detects a predetermined wound quantity suitable for a bobbin exchange. The predetermined wound quantity is set at a wound quantity obtained after an elapse of a predetermined time from the empty condition of bobbins for winding yarn, for example, 20% of a full size when producing a yarn having a coarse count and 40% of a full size when producing a yarn having a medium count, whereby, if the normal spinning condition can be maintained, sufficient time is available to complete the roving bobbin exchange operation in cooperation with the roving-ends piecing operation before the cop becomes over-full. The automatic counter AC is a two-preset-value counter in which the above-mentioned predetermined wound quantity and the fully wound quantity are preset as set values. A circuit (3) is a doffing counter circuit including a doffing counter DC, and in this circuit (3), a contact RYB, which is closed by a doffing instruction output issued by the above-mentioned automatic counter AC, is connected to a counting input of the doffing counter DC when the wound quantity reaches the fully wound quantity, and an a-contact RY3-1 of a roving bobbin exchange confirming relay RY3 described hereinafter is connected to a resetting input of the doffing counter DC, whereby a residual roving quantity indicating means for outputting a bobbin exchange signal (second signal) by closing a counter contact DC1 arranged in this circuit when the doffing counter DC detecting the supplied roving quantity, detects that the amount of residual roving of the roving bobbin in the creel is approaching the predetermined wound quantity suitable for requesting a bobbin exchange operation. The predetermined wound quantity of the roving bobbin is set, for example, to ½ of the possible number of full packaged cops which can be produced by one full packaged roving bobbin. For example, where one full packaged roving bobbin can produce 22 full packaged cops, the set value is 11. A circuit (4) is a circuit for calling the roving bobbin exchange apparatus in which the counter contact AC1 of the automatic counter AC, the counter contact DC1 of the doffing counter DC, and the calling lamp L are connected in series, and an auxiliary relay RY1 is connected in parallel to the calling lamp L, so that when both of the above-mentioned counter contacts AC1 and DC1 are closed (i.e., a logical product is taken), the calling lamp L is lit. A circuit (5) is an allowable approach time setting circuit including the timer TR1 (time setting means) for setting an allowable approach time T as the set time value. This allowable approach time T is set so that if the roving bobbin exchange apparatus 4 approaches the spinning frame SF within this allowable time T after the output of the calling signal (third signal) and the normal bobbin exchange operation is started, the bobbin exchange operation is completed within a time such that the spinning bobbin does not become a full package and the roving bobbin does not reach an exhausted condition.

An a-contact of RY1-1 of the auxiliary relay RY1 and a b-contact RY2-1 of an approach confirming relay RY2 described hereinafter are connected in series to the timer input of the timer TR1, so that counting is started simultaneously with the output of the calling signal in the circuit (4). An a-contact RY2-2 of the approach confirming relay RY2 is connected to the reset input of the timer TR1.

A circuit (6) is an approach confirmation circuit for connecting the approach confirmation switch (first limit switch) LS1 to the approach confirmation relay (b-contact relay) RY2, and while the apparatus 4 approaches the spinning frame SF, the contact of the approach confirmation switch LS1 is kept closed. A circuit (7) is a circuit for confirming the completion of the bobbin exchange operation, and includes the bobbin exchange confirmation switch(a second limit switch) LS2, a contact RY2-2 and, the roving bobbin exchange confirming relay RY3. A circuit (8) is an allowable bobbin exchange time setting circuit including the timer TR2 for setting an allowable bobbin exchange time as the set time value, and an a-contact RY2-4 of the approach confirmation relay RY2 and a b-contact RY3-2 of the above-mentioned relay RY3 are connected to the timer input of the timer TR2 so that counting is started simultaneously with a confirmation of the approach of the apparatus 4 to the spinning frame SF. An a-contact RY3-3 of the above-mentioned relay RY3 is connected to the reset input of the timer TR2, so that when the second limit switch LS2 in the circuit 7 is turned ON (bobbin exchange completion signal output), the timer TR2 is reset. The allowable bobbin exchange time of the timer TR2 is set at a normal operation time of the apparatus 4, i.e., the time of the bobbin exchange operation which is carried out without problems. Note, a method may be adopted in which the counting in the timer TR2 and the counting in the above-mentioned timer TR1 are simultaneously started and the allowable bobbin exchange time is set at the sum of the above-mentioned normal operation time of the roving bobbin exchange apparatus and the above-mentioned allowable approach time T. A circuit (9) is a re-starting signal output circuit including the auxiliary relay (a driving motor re-starting relay) RY4, and a circuit (10) is a re-starting signal cutting circuit including a timer TR3 in which the time count is completed after the lapse of a predetermined time from the time of re-starting the drive motor M.

Figure 5:
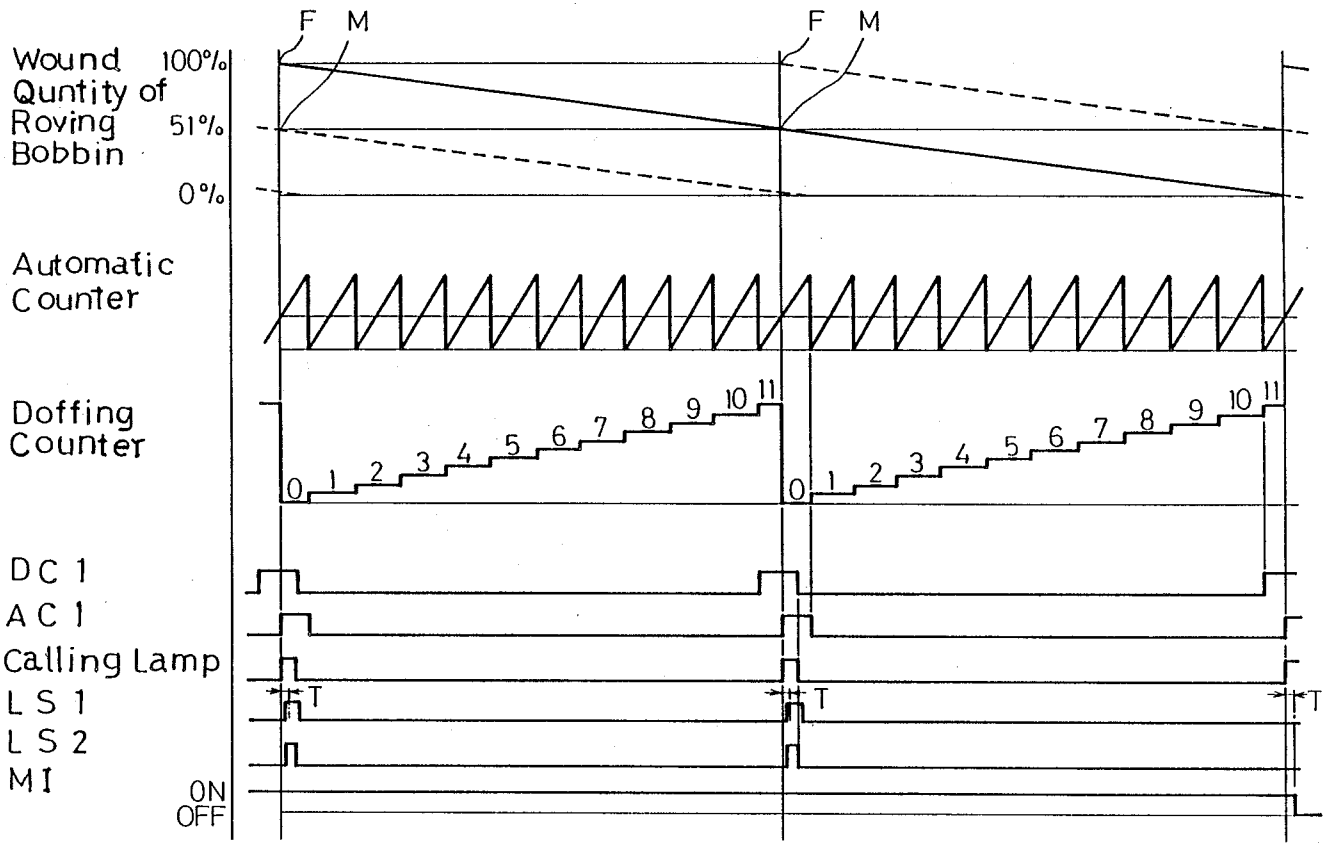
FIG. 5 is a timing chart showing the timing of counters actuated by the control circuit shown in FIG. 4 and signals output therefrom; and, FIG. 6 is a diagram of the roving bobbin exchange operation according to one embodiment of the present invention.

The function of the operation control apparatus having the above-mentioned construction will now be described in detail. In each spinning frame SF to which the present invention is applied, at the time of starting the spinning operation, full packaged roving bobbins and half exhausted roving bobbins are alternately suspended by bobbin hangers of a front row 19*a* and a back row 19*b* in the creel 19 of each spinning frame SF, in a condition such that each front bobbin hanger and each back bobbin hanger, facing each other, is suspending roving bobbins in an identical roving winding condition. The half-exhausted roving bobbin is hereinafter referred to as M. A description will now be given of a case wherein a yarn having a medium count is spun by the spinning frames SF, each provided with a main drive motor Ml which is operated by depressing the push button switch PB1, which excites the relay MS1 in the circuit (1), and 22 full size cops are produced from one full packaged roving bobbin F. Referring to FIG. 5, when the automatic counter AC counts a number indicating the cops are now full size, the automatic doffing and donning device 12 outputs a doffing instruction signal, and simultaneously, the contact RYB in the circuit (3) is closed so that the doffing times are counted in the doffing counter DC. When the counted value reaches the preset value 11, the medium-roving bobbin M has become an almost exhausted roving bobbin S (the quantity of residual roving is about 5%) which condition is suitable for carrying out roving bobbin exchange operation by the apparatus 4. At this time, the counter contact DC1 of the circuit 4 is closed as the first signal to request bobbin exchange operation, and when the count value of the automatic counter AC reaches the set value suitable for the bobbin exchange (for example, the value corresponding to ¼ of the fully wound quantity) (at this point, the amount of the residual roving is about 2%, and this value is substantially the quantity of the residual roving to be exchanged), the counting is terminated and the counter contact AC1 of the circuit 4 is closed as the second signal to request bobbin exchange operation, whereby the logical product of these two bobbin exchange signals is created and the calling lamp L of the circuit 4 is lit as the calling signal and the auxiliary relay RY1 is turned ON. Namely, the AND operation of the first and second signals is logically conducted to form the calling signal, whereby the calling lamp L of the circuit 4 is lit, and simultaneously, the auxiliary relay RY1 is turned ON. During this period, spinning of the spinning frame SF is continued. At this time, the a-contact RY1-1 of the circuit 5 is closed, and since the b-contact RY-2 and the a-contact RY1-1 are closed, the timer TR1 begins counting. If the carrier 2 is carrying the roving bobbin exchange apparatus 4 and the calling lamp L is lit before the time count is completed by the timer TR1, the carrier 2 is stopped at a position close to the end of the spinning frame SF at which the calling lamp L is lit, and after a withdrawal of a blow cleaner (not shown) moving along the frame of the spinning frame SF, the bridge rails 6 are connected to the guide rails 14. At this point, the first limit switch, that is, the approach confirming switch LS1 is turned ON to excite the approach confirming relay RY2 of the circuit 6, the contacts RY2-2, RY2-3 and RY2-4 of the circuits 5, 7 and 8 are closed, the the timer TR1 is reset while the timer TR2 begins counting. The roving bobbin exchange apparatus 4 which has thus arrived at the position close to the end of the spinning frame SF moves along the spinning frame SF at predetermined displacement pitches. As shown in FIG. 6, in the bobbin exchange operation, the following steps are carried out. As a first step of the operation, free ends of the rovings from two full packaged roving bobbin F, which are taken from the respective bobbin hangers of the bobbin carriage on the supply rail 9 by the pegs 8, are pieced to the corresponding rovings from the almost exhausted roving bobbins S suspended by the front and back bobbin hangers, facing each other in the creel 19, and then the rovings from these almost exhausted roving bobbins S are cut downstream of the pieced portions of the rovings created by the above-mentioned piecing operation, before being supplied to the respective draft parts of the spinning frame SF, so that the rovings from the above-mentioned full packaged roving bobbins F supported by the pegs 8 are supplied to the above-mentioned draft parts. In this condition, the above-mentioned full packaged roving bobbins F are again suspended by the corresponding bobbin hangers of the carrier 2 on the supply rail 9. Next, the almost exhausted roving bobbins S, which have completed the first step of the operation, are taken from the front and back bobbin hangers of the creel 19 by a pair of pegs 7, the axial distance therebetween can be expanded, and then these almost exhausted roving bobbins S are suspended by a pair of adjacent two empty bobbin hangers (indicated by X in FIG. 6) on the supply rail 9, and thereafter, the above-mentioned two full packaged roving bobbins F, which have completed the above-mentioned step of the operations, are transferred to the front and back bobbin hangers of the creel 19 from which the almost exhausted roving bobbin S were taken, so that a unit cycle operation of the roving bobbin exchange operation is completed. The above-mentioned unit cycle operation for carrying out the roving bobbin exchange operation is carried out for the almost exhausted roving bobbins S suspended by the front and back bobbin hangers of the creel 19, which are located alternately along the creel 19, as mentioned above, from the gear end side to the outer end side of the spinning frame along the creel 19, and when the apparatus 4 arrives at the position facing the out end of the spinning frame SF, the apparatus actuates the second limit switch, that is the bobbin exchange confirmation switch LS2. If the bobbin exchange is performed without delay but the time count is not completed in the timer TR2, the first limit switch, that is the approach confirmation switch LS1 of the circuit (6) is not closed and the a-contact RY2-2 of the circuit (5) is kept open, and the reset signal is not input, and the timer TR1 becomes to time-up so that the time limiting contact TR1-1 of the circuit (1) is opened to de-energize the relay MS1 and stop the drive motor M1, and the spinning operation of the spinning frame SF is temporarily stopped. Accordingly, the roving bobbins having a smaller quantity of roving and supplying rovings to the above-mentioned spinning frame SF, do not reach a completely exhausted condition. Simultaneously, the time limiting contact TR1-2 of the circuit 9 is closed. When the apparatus 4 then approaches the spinning frame SF concerned, the approach confirmation switch LS1 of the circuit (6) is turned on to excite and self-retain the relay RY4 of the circuit (9), and the a-contact RY4-1 of the circuit (1) is closed to excite and self-retain the relay MS1. Accordingly, the driving motor Ml of the spinning frame SF is automatically started again and the supply of roving is restarted, and the apparatus 4 performs the bobbin exchange operation while spinning is continued, as mentioned above. Simultaneously, the timer of the circuit (10) TR3 begins counting, and when the time count is completed in the timer TR3, the timer contact TR3-1 is opened after the lapse of a predetermined time from the time of re-starting. Where the bobbin exchange operation is not completed within the above-mentioned allowable bobbin exchange time even if the apparatus 4 has approached the spinning frame, the time count is completed in the timer TR2 to open the time limiting contact TR2-1 of the circuit (1) and stop the spinning frame SF. Accordingly, the disadvantage that the roving of the small-roving bobbin S which will be the subjected to the roving bobbin exchange operation, is exhausted so that the above-mentioned piecing operation of rovings becomes impossible, can be eliminated.

In the above-mentioned embodiment, full packaged roving bobbins F and medium size roving bobbins M are alternately suspended by the front row of bobbin hangers and the back row of bobbin hangers in a condition such that each front bobbins hanger and a back bobbin hanger facing thereto suspends roving bobbins having an identical roving winding size, and when the medium roving bobbins M become almost exhausted roving bobbins S, the roving bobbin exchange operation by the apparatus 4 is applied to these almost exhausted roving bobbins S. The present invention also can be applied to a process in which the bobbin exchange is conducted in succession, as disclosed in Japanese Unexamined Patent Publication No. 62-53425 (EPC Unexamined Patent Publication No. 0213962) explained hereinbefore with reference to the conventional technique. Moreover, the apparatus for controlling the operation of a spinning frame according to the present invention can be applied to a bobbin exchange system in which only the bobbin exchange is automatically carried out and the roving piecing operation is manually conducted. In this case, at the bobbin exchange, the roving of the almost exhausted roving bobbin S is cut in the vicinity of the roving guide, and the piecing operation is manually performed while this roving is moving to supply a draft part for this roving. Furthermore, the residual roving quantity indicating means and cop wound quantity indicating means can be constructed by a pulser which is connected to a back roller of the spinning frame SF and generates a pulse every time a predetermined length of the roving is fed by the rotation of the back roller, and a feed counter, which receives pulse signals from the pulser and integrates the quantity of fed roving or the quantity of fed roving corresponding to the quantity of yarn wound on the cop respectively. An automatic counter having a large preset number can be arranged as the time setting means instead of the timer. In this case, the sum of the quantity of produced yarn wound on the cop before the output of the bobbin exchange signal and the quantity of produced yarn wound on the cop during the above-mentioned allowable time is set as the wound quantity allowable for the approach of the roving bobbin exchange apparatus 4 in the automatic counter, and if a signal indicating the arrival of the apparatus 4 is not input before the above-mentioned allowable time is detected by the automatic counter, the drive motor is stopped. Note, in the present embodiment, the control circuit is illustrated as a circuit including relays and the like, but in the present invention, the control circuit can be constructed by a programmable controller now used frequently for electric control (provided with a microcomputer-equipped or internal timer-equipped device capable of programmably rearranging a sequential control circuit). Furthermore, when the roving bobbin exchange apparatus 4 approaches the spinning frame SF after stopping of the spinning frame, the drive motor M1 can be manually restarted.

As is apparent from the above-mentioned description, according to the present invention, in a roving bobbin exchange system for exchanging almost exhausted roving bobbins suspended by respective bobbin hangers of a creel of a spinning frame, for full packaged roving bobbins suspended by bobbin hangers of a bobbin carriage on a supply rail, in parallel to the roving piecing operation of the tail end of each almost exhausted roving bobbin with the front end of rovings from the corresponding full packaged roving bobbin, a bobbin exchange signal is outputted when the roving quantity on a roving bobbin approaches a predetermined wound quantity for carrying out the bobbin exchange operation, another bobbin exchange signal is then outputted when the quantity of produced yarn wound on a cop becomes a quantity suitable for the bobbin exchange, a calling signal requesting the roving bobbin exchange apparatus 4 is outputted based on a logical product of both the signals and a drive motor of the spinning frame is stopped when the roving bobbin exchange apparatus does not approach the spinning frame concerned within a predetermined allowable time after the output of the calling signal. The possibility of the occurrence of a situation, wherein the roving bobbins to be subjected to the roving bobbin exchange operation become completely exhausted, can be prevented, and accordingly, if the spinning frame is restarted after the arrival of the roving bobbin exchange apparatus at the working position thereof facing the outer end frame of a spinning frame which has outputted the calling signal, the piecing operation between free ends of rovings from the full packaged roving bobbin with a tail ends of corresponding almost exhausted roving bobbins of the spinning frame can be easily carried out, while maintaining a continuous driving of the spinning frame concerned, without stopping the spinning by a certain spindle due to a failure of the roving piecing operation. Furthermore, since the bobbin exchange operation is performed when the quantity of residual roving of the roving bobbins, which will be subjected to the roving bobbin exchange operation, becomes the quantity for which the roving bobbin exchange is necessary, and the quantity of produced yarn wound on the cop becomes the quantity suitable for the bobbin exchange, the doffing operation of the spinning frame does not overlap the bobbin exchange operation. This is another advantage attained by the present invention.

We claim:

1. In a roving bobbin exchange system for a group of conventional spinning frames producing yarn wound on cops wherein almost exhausted roving bobbins suspended by respective bobbin hangers of a creel of said spinning frame are exchanged for full packaged roving bobbins suspended by respective bobbin hangers of a bobbin carriage on a supply rail arranged at a position close to and above said spinning frame, in cooperation with a roving piecing operation between each one of said almost exhausted roving bobbins and a corresponding one of said full packaged roving bobbins, by an apparatus for exchanging roving bobbins which is capable of displacing along a spindle rail of said spinning frame, an apparatus for controlling a drive of each one of said group of spinning frames, comprising:

a residual roving quantity indicating means for detecting a quantity of roving supplied from said roving bobbins and emitting a roving bobbin exchange signal when said roving quantity detected thereby approaches a predetermined wound quantity suitable for said roving bobbin exchange operation;

further indicating means for detecting a quantity of yarn wound on said cop and emitting a signal, when a yarn quantity detected thereby reaches a value suitable for carrying out said roving bobbin exchange operation, said two indicating means being disposed on each of said spinning frames;

a control circuit for emitting a calling signal for calling said roving bobbin exchange apparatus based on a logical product of said first and second signals;

an approach confirmation switch for confirming an arrival of said roving bobbin exchange apparatus disposed at an outer end frame of a spinning frame, being capable of emitting a third signal which confirms the arrival of said roving bobbin exchange apparatus;

an allowable time setting means capable of being actuated when said calling signal is issued from said spinning frame, for setting an allowable time from a time of issuing said calling signal to a time limit at which said roving bobbin exchange apparatus should have arrived;

said approach confirmation switch and allowable time setting means being arranged to cooperate with said control circuit;

said control circuit being further provided with electric means for starting and stopping a drive of said spinning frames and cooperating with said approach confirmation switch and said allowable time setting means, whereby, when said third signal is not outputted within said allowable time set by said allowable time setting means after an output of said calling signal in said control circuit, said electric means for stopping and starting a drive of said spinning frame stops the drive of said spinning frame.

2. An apparatus for controlling the drive of each one of said group of spinning frames according to claim 1, further provided with a timer which sets an allowable time for completing said roving bobbin exchange operation for said spinning frame from a time point issuing said third signal, an electric circuit for setting said allowable time for completing said roving bobbin exchanging operation, wherein said timer is combined, means for issuing a signal (fourth signal) indicating completion of said roving bobbin exchange operation, each one of said spinning frames provided with said electric circuit and said signal issuing means, whereby, when said fourth signal is not issued within said allowable time for completing said roving bobbin exchange operation, said electric means for starting and stopping a drive of said spinning frame is actuated to stop a drive of said spinning frame.

3. An apparatus for controlling a drive of each one of said group of spinning frames according to claim 1, said control circuit being provided with an auxiliary circuit for restarting a drive of said spinning frame, if said spinning frame has outputted said calling signal and a drive of said spinning frame was stopped because said third signal was not outputted within said allowable set time, when said third signal is outputted.

4. An apparatus for controlling a drive of each one of said group of spinning frames according to claim 1, wherein said residual quantity indicating means is a doffing counter which counts a number of doffings of said spinning frame.

5. An apparatus for controlling a drive of each one of said group of spinning frames according to claim 1, wherein said residual quantity indicating means is a pulse generator connected to a back roller of each one of said spinning frames, and a feed counter connected to a corresponding one of said pulse generators.

6. An apparatus for controlling a drive of each one of said group of spinning frames according to claim 1, wherein said means for detecting a quantity of yarn wound on said cop is a detecting switch connected to a front roller of each one of said spinning frames, and an automatic counter actuated by a signal output by a corresponding one of said detecting switches.

* * * * *